US009058769B2

(12) United States Patent
Bert et al.

(10) Patent No.: US 9,058,769 B2
(45) Date of Patent: Jun. 16, 2015

(54) METHOD AND SYSTEM FOR COMPENSATING AGEING EFFECTS IN LIGHT EMITTING DIODE DISPLAY DEVICES

(75) Inventors: Tom Bert, Lochristi (BE); Tom Kimpe, Ghent (BE)

(73) Assignee: BARCO N.V., Kortrijk (BE)

( * ) Notice: Subject to any disclaimer, the term of this patent is extended or adjusted under 35 U.S.C. 154(b) by 962 days.

(21) Appl. No.: 13/061,591

(22) PCT Filed: Aug. 28, 2009

(86) PCT No.: PCT/EP2009/061121
§ 371 (c)(1),
(2), (4) Date: May 4, 2011

(87) PCT Pub. No.: WO2010/023270
PCT Pub. Date: Mar. 4, 2010

(65) Prior Publication Data

US 2011/0242074 A1 Oct. 6, 2011

(30) Foreign Application Priority Data

Sep. 1, 2008 (EP) ..... 08163445

(51) Int. Cl.
*G09G 5/00* (2006.01)
*G09G 3/32* (2006.01)

(52) U.S. Cl.
CPC ..... *G09G 3/3208* (2013.01); *G09G 2310/0227* (2013.01); *G09G 2320/0242* (2013.01); (Continued)

(58) Field of Classification Search
CPC ..... G09G 2300/0842; G09G 3/3233; G09G 2320/043; G09G 2360/148; H05B 33/12
USPC ..... 345/76–83, 207; 315/169.1–169.3, 315/169.1–169.4
See application file for complete search history.

(56) References Cited

U.S. PATENT DOCUMENTS 5,157,525 A * 10/1992 Eaton et al. ..... 345/87
6,191,764 B1 * 2/2001 Kono et al. ..... 345/76

(Continued)

FOREIGN PATENT DOCUMENTS

EP 1158483 11/2001
EP 1274066 1/2003

(Continued)

OTHER PUBLICATIONS

Examination Report of EPO regarding EP 09-782 320.7, Jul. 23, 2012.

(Continued)

*Primary Examiner* — Kimnhung Nguyen
(74) *Attorney, Agent, or Firm* — Bacon & Thomas, PLLC

(57) ABSTRACT

The present invention relates to a method for compensating ageing effects of pixel outputs displaying an image on a display device. The method involves displaying a first image on an active display area (6) on the display device (1) having a first plurality of pixels; displaying a second image on a sub-area (7) of the display device (1) and having a second plurality of pixels, the active display area (6) being larger than the sub-area (7) and the second image being smaller than the first image and having fewer pixels than the active display area (6); driving the pixels of the sub-area (7) with pixel values that are representative or indicative for the pixels in the activity display area (6); making optical measurements on light emitted from the sub-area (7) and generating optical measurement signals (11) therefrom, and; controlling the display of the image on the active display area (6) in accordance with the optical measurement signals (11) of the sub-area (7).

19 Claims, 6 Drawing Sheets

(52) U.S. Cl.
CPC .. *G09G2320/0285* (2013.01); *G09G 2320/029* (2013.01); *G09G 2320/041* (2013.01); *G09G 2320/043* (2013.01); *G09G 2320/048* (2013.01); *G09G 2320/0693* (2013.01); *G09G 2360/144* (2013.01); *G09G 2360/145* (2013.01)

(56) References Cited

U.S. PATENT DOCUMENTS

| | | | | |
|---|---|---|---|---|
| 6,320,325 | B1 | 11/2001 | Cok et al. | |
| 7,551,158 | B2 * | 6/2009 | Nishimura et al. | 345/102 |
| 2005/0280766 | A1 | 12/2005 | Johnson et al. | |
| 2006/0066547 | A1 * | 3/2006 | Nitta et al. | 345/88 |
| 2006/0119592 | A1 | 6/2006 | Wang et al. | |
| 2006/0164407 | A1 * | 7/2006 | Cok | 345/204 |
| 2007/0097041 | A1 | 5/2007 | Park et al. | |
| 2008/0055209 | A1 | 3/2008 | Cok | |
| 2008/0055210 | A1 | 3/2008 | Cok | |
| 2008/0122819 | A1 | 5/2008 | Cho et al. | |
| 2008/0204438 | A1 * | 8/2008 | Song et al. | 345/207 |

FOREIGN PATENT DOCUMENTS

| | | | |
|---|---|---|---|
| EP | 1879169 | A1 | 1/2008 |
| WO | 0163587 | | 8/2001 |
| WO | 2006065185 | | 6/2005 |
| WO | 2008019487 | | 2/2008 |

OTHER PUBLICATIONS

Examination Report of EPO regarding EP 09 782 320.7-1228, Sep. 19, 2011.

International Search Report in PCT/EP2009/061121, Dec. 21, 2009.

Written Opinion of ISA in PCT/EP2009/061121, Dec. 21, 2009.

Response to Written Opinion of ISA in PCT/EP2009/061121, Jul. 1, 2010.

International Preliminary Report on Patentability of IPEA in PCT/EP2009/061121, Aug. 27, 2010.

Summons to attend oral proceedings pursuant to Rule 115(1) EPC, dated Dec. 16, 2014, for EP 09782320.7.

* cited by examiner

METHOD AND SYSTEM FOR COMPENSATING AGEING EFFECTS IN LIGHT EMITTING DIODE DISPLAY DEVICES

TECHNICAL FIELD OF THE INVENTION

The present invention relates to a system and method for detecting and/or visualising and/or compensating ageing effects of an image displayed on a display device subject to ageing such as an OLED display. It applies more particularly, but not exclusively, to active matrix type OLED displays intended to be used for medical imaging.

More particularly, the present invention relates to a display device that has a high contrast ratio, wide viewing angle, extremely fast response time, and accurate imaging over the whole lifespan of the display device.

BACKGROUND OF THE INVENTION

At present, it is known that OLED displays can be equipped with means for compensating the loss of luminescence due to ageing, whereby such compensation in part is carried out in view of the differential ageing of the individual pixels. The differential ageing of the individual pixels occurs due to the different drive levels of each pixel over the lifespan of the display. For example, if there is often a blue sky displayed at the top part of the device, the blue pixels in this part of the display will show ageing effects such as reduced luminescence and/or reduced performance faster that other pixels of the display. This is a problem that much less exists with LCD display devices to the same degree.

There are two types of compensation methods and systems known which address the problem of differential ageing of OLED display devices. The first method and system comprises the integration of a light sensor circuit in each individual pixel that acts as a feedback circuitry. The current can be increased depending upon this feedback signal to compensate for the loss of luminescence and/or performance. Obviously, the higher the current to drive the pixel for compensating the loss of performance due to ageing, the faster the pixel ages further so as the pixel reaches the end of its life the failure becomes more rapid. While this approach is very accurate it has severe drawbacks in terms of cost implications, scaling and reducing the size of the pixels for higher resolutions, and complicated drive and production processes.

A second method for detecting and compensating the differential ageing effect of OLED display devices is based on a "model" approach. By keeping track, e.g. in non-volatile storing, of how much each individual pixel was driven over the lifetime of the display device a prediction of the reduction in performance for each pixel can be made based on a model. This can be done by analysing the video content or by monitoring the on-current time of each pixel. The second method is representing a much cheaper and simple solution but its accuracy is heavily dependent on the quality of the model used. Environmental factors such as temperature and moisture during the time of use can not be taken into account. Therefore, in practice this second method does not show very accurate results and still some part of the differential ageing problem remains visible. Thus, this type of compensation would not be acceptable for display devices used in medical imaging.

From US 2008/0055209 A1 and US 2008/005210 A1 a method for reducing brightness uniformity variations in active matrix OLED displays employing amorphous silicon thin-film transistors during its actual use is known. The method relates to selecting a representative group of pixels which are preferred to be evenly distributed over the whole display and measuring the total representative current of all selected pixels in response to known image signals. Based on that measurement a correction value is derived from an estimated value of light emitting element performance in response to known image signals. Then, the corrected value is employed to correct the image signals for the changes in the output of the light emitting elements and to produce compensated image signals. The method is based on the measurement of total current for a group of pixels which has the drawback that only an estimation for the actual behaviour of the OLED pixels can be used depending on the measured current. Moreover, the method is concentrating on uniformity and brightness corrections especially for large scale displays and thus the selection of representative pixels has to be made with an even distribution over the whole display device. Differential ageing effects of the OLED pixels are not detected or compensated by this method.

WO 2008/019487 A1 discloses a system and method for determining a pixel capacitance in OLED pixels. As the pixel capacitance is correlated to a pixel age a current correction factor can be determined to compensate the pixel drive current and account for degradation of the pixel that results from the pixel ageing. However, the system includes means for reading the pixel capacitance in each pixel circuit. That again results in a complicated built showing the above mentioned drawbacks for the sensor based correction method. Moreover, the method can not include information about the past operation of the OLED pixels to compensate for the degradation.

Further, WO 01/63587 A3 describes a method and apparatus for calibrating OLED display devices and automatically compensating for loss in their efficiency over time. The disclosed method is representative for the above mentioned "model" approach and is based on measuring the driving current for each individual pixel and the corresponding light efficiency. On the basis of that data a second light efficiency is calculated for each pixel taking a special decay factor into account and the driving current is altered depending on a factor proportional to the ratio of the first and second light efficiencies. For calibration of the OLED display device a photodetector, such as a camera, is stepwise moved in front of the display from sub-area to sub-area of the display in order to measure the light output of the actual sub-area and compare the output with the light output of the foregoing sub-area. Like that, uniformity over the whole display is achieved.

The described model approach for compensating the ageing effects of the OLED pixels is solely based on the uniform prediction of degradation of the pixels put into the model as well as the measurement of the current. Thus, the compensation achieved is not as accurate as it is required for an application in medical imaging.

SUMMARY OF THE INVENTION

It is an object of the present invention to provide a system and method for detecting and/or visualising and/or compensating ageing effects of an image displayed on a display device subject to ageing effects.

This object is accomplished by a method and a system according to the present invention.

The present invention provides a method for detecting and/or visualising and/or compensating ageing effects, especially based on ageing of the pixels, of an image displayed on a display device, comprising:

displaying a first image on an active display area on the display device having a first plurality of pixels, displaying a second image on a sub-area of the display device and having a second plurality of pixels, the active display area being larger than the sub-area and the second image being smaller than the first image and having fewer pixels than the active display area driving the pixels of the sub-area with pixel values that are representative or indicative for the pixels in the active display area, making optical measurements on light emitted from the sub-area and generating optical measurement signals therefrom, and controlling the display of the image on the active display area in accordance with the optical measurement signals of the sub-area.

The active display area and the sub-area are in one single display device. The display can be an OLED display. The method of the present invention provides a new approach for compensating ageing effects, and especially differential ageing effects, of pixels subject to ageing effects such as OLED pixels in an OLED display device, by using actual data derived from an optical measurement of pixels that have been driven in a representative manner compared to the display as a whole. Accordingly, the second image can be selected from parts of the first image in a way that the second image is representative of the first image but smaller in size. As the display comprises the active display area and the sub-area in one single display device the ageing effects caused by running the display as a whole like the temperature changes and the exposure to oxygen levels in the air is the same for the pixels of the active display area and of the sub-area which leads to a very high accuracy of the compensation method. Alternatively or additionally, the second image can contain a pattern of predefined pixel values, acting as a generic reference for any possible content of the first image, i.e. indicative of ageing of pixels of the first area. Advantageously this can be combined with the "model" approach to compensate for ageing effects more accurately.

A light sensor faces the sub-area of the screen, for instance in a corner of the screen, and measures the light coming from this small sub-area. The pixels such as OLED pixels of the sub-area are driven to give a small image that is representative of the image on the complete screen. This small image e.g. can be obtained by resealing the first display image to a smaller size (second display image). The exact scaling algorithm used is not considered a limitation of the present invention. Based on the actual display contents the typical driving values can be identified for each pixel or a representative group of pixels of the sub-area and the actual behaviour of these pixels can be determined at any moment of the drive time. Like that, a more accurate correction especially for the differential ageing effects is achieved without the need to integrate a sensor in each individual pixel of the complete screen and without storing the drive history of each pixel of the complete screen.

In a preferred embodiment of the present inventive method the sub-area can again be divided into different parts which are driven with a pattern based on the actual display contents. Typical driving values such as a dynamic pattern like moving images, or temporal dither patterns of the actual displayed image can be identified for this purpose and at least one part of the sub-area of the display device can be driven with that pattern. At the same time, for each individual pixel of the sub-area the data how the pixel has been driven over the lifetime of the display can be stored. By measuring characteristics of the test patterns, parameters of an aging model can be estimated. These parameters then can be used, in combination with information on how display pixels have been driven over the lifetime of the display, to predict the aging behaviour of display pixels. In contrast to making an estimated prediction of the actual behaviour based on a model only, with the method of the present invention now a measurement of the current behaviour of a given class of pixels like blue pixels at the top of the display device can be provided instead of storing the complete driving behaviour of each pixel of the complete display and instead of an inaccurate estimation based on a current measurement and/or a model. Moreover, the memory used to store the driving history of each of the sub-area pixels or alternatively of classes of these pixels from parts of the sub-area can be reduced.

The method for correction of an image is used in real time, i.e. in parallel with a running application. The method is intervention-free, it does not require input from a user.

Preferably, the optical measurements carried out are luminance measurements. In that case, light output correction may comprise luminance and/or contrast correction. Alternatively, the optical measurements carried out are colour measurements, in which case light output correction comprises colour correction of the displayed image.

Controlling the display of the image in accordance with the optical measurement signals is preferably done by comparing the measurement signals with a reference value, and regulating the driving current of the pixels so as to reduce the difference between the reference value and the measurement signals and bring this difference as close as possible to zero.

According to another preferred embodiment of the invention the luminance measurements are carried out in sequences. For example, at a time zero not all parts of the sub-area of the active display are used for measuring but it is also possible to reserve one part or zone of the sub-area which can be temporarily driven with zero. After 1000 hours, for example, the reserved part or zone can be used to start a new series of luminescence measurements. With this reservation it is possible to measure the degradation of differently driven pixels and then make a more accurate prediction of the degradation behaviour of the pixels such as OLED pixels.

Alternatively, the sub-area can be used and measured continuously to show the same image as the complete active display at all times. The optical measurement then is used to identify the remaining efficiency of every gray level and/or every colour. This degradation is stored in a table which shows degradation per gray level and/or colour over time.

Preferably, the step of making optical measurements furthermore comprises a step of transmitting the light emitted from the active display sub-area from within the active display sub-area to outside the active display sub-area.

It is another preferred embodiment of the present inventive method to also track in time how a pixel of the sub-area was driven. This is contrast to only track a total drive time. This allows to have an even more accurate model because it also takes into account the exact degradation at a particular moment of the lifespan. For example, if a measurement includes the measurement of all grey levels every 30 minutes it is possible to look for every pixel of the sub-area and subsequently of the whole display area what the degradation was when driving a pixel at a certain video level and moreover at a certain moment in time. This ultimately allows an accurate compensation with environmental changes, e.g. in temperature or moisture levels, also included into the model.

The present invention also provides a system for compensating ageing effects, especially based on differential ageing of pixels such as OLED pixels, of an image displayed on an OLED display device. The system according to the present invention comprises:

a display device comprising an active display area for displaying the image, an image forming device, such as an array of OLED pixels, and an electronic driving system for driving the image forming device, an optical sensor unit comprising an optical aperture and a light sensor having an optical axis, to make optical measurements on a light output from a sub-area of the active display area of the image forming device and generating optical measurement signals therefrom, a feedback system receiving the optical measurement signals and on the basis thereof controlling the electronic driving system, wherein the sub-area of the active display area is adapted to show an image that is representative or indicative of the image of the complete active display area.

The active display area and the sub-area are in one single display device. The optical aperture of the optical sensor unit preferably has an acceptance angle such that at least 50% of the light received by the sensor comes from light travelling within 15° of the optical axis of the light sensor (that is the acceptance angle of the sensor is 30°). In other words the acceptance angle of the sensor is such that the ratio between the amount of light used for control which is emitted or reflected from the display area at a subtended acceptance angle of 30° or less to the amount of light used for control which is emitted or reflected from the display area at a subtended acceptance angle of greater than 30° is X:1 where X is 1 or greater. Under some circumstances it may be advantageous to have an acceptance angle such that at least 60%, alternatively at least 70% or at least 75% of the light received by the light sensor comes from light travelling within 15° of the optical axis of the light sensor.

In another preferred embodiment of the invention a system for compensating ageing effects, especially based on differential ageing of the pixels, of an image displayed on an OLED display device is provided where the optical aperture of the optical sensor unit has an acceptance angle such that light received at the sensor at an angle with the optical axis of the light sensor equal to or greater than 10° is attenuated by at least 25%, light received at an angle equal to or greater than 20° is attenuated by at least 50 or 55% and light arriving at an angle equal to or greater than 35° is attenuated by at least 80 or 85%.

The system according to the present invention is meant to be used in real time, thus during display of a main application. No test pattern is necessary, although a test pattern may be used for calibration. The main application is not disturbed when the measurement is made.

The optical measurements are non-differential, i.e. ambient light and real light emitted by the active display area are not measured separately. Direct ambient light is not measured, nor does it influence the measurement appreciably. Indirect ambient light (i.e. ambient light reflected by the display) has a contribution in the total luminance output of the electronic display, and will be measured.

In case it is the intention to adjust the luminance of a display relative to the ambient light, the combination of the invention with a separate ambient light sensor is possible. In that case, a system according to the present invention measures the luminance emitted by the sub-area of the screen, and the ambient light sensor measures the ambient light. The display's luminance can then be adjusted in proportion to the difference between both.

Ambient light also can be measured by performing two measurements: a first measurement with display active (measuring ambient light+display light) and then a measurement with display inactive (measuring purely ambient light). The difference between those two measurements gives an indication of the display luminance relative to the (reflected) ambient light.

Preferably, the optical measurements are luminance measurements. The performance correction may then comprise luminance and/or contrast correction. The optical measurements may also be colour measurements, in which case a colour correction may be carried out.

The feedback system preferably comprises a comparator/amplifier for comparing the optical measurement signals, measured luminance or colour values, with a reference value, and a regulator for regulating a backlight control and/or a video contrast control and/or a video brightness control and/or a colour temperature, so as to reduce the difference between the reference value and the measured value and bring this difference as close as possible to zero.

The optical sensor unit of the present invention preferably comprises a light guide between the optical aperture and the light sensor. This light guide may be e.g. a light pipe or an optical fibre.

Preferably, the sub-area of the active display area of the OLED image forming device is less than 1% of the total area of the active display area of the image forming device, preferably less than 0.1%, and still more preferred less than 0.01%.

According to a preferred embodiment, the optical aperture of the optical sensor unit masks a portion of the active display area, while the light sensor itself does not mask any part of the active display area. The light output from the front face of the active display area of a display device is continuously measured with a minimal coverage of the viewed image. The light sensor may be brought to the back of the display area or to a side thereof, thereby needing a height above the screen area preferably less than 5 mm. Therefore, a distance between the optical aperture and the light sensor, needed to reject ambient light during measurement, is not created by a distance out of the screen.

The sub-area measured on the screen is composed of a number of active pixels such as OLED pixels of the active display area. The sub-area of active pixels measured on the screen is preferably not larger than 6 mm×4 mm. For example for a mobile phone screen, with typical dimensions of the active display area of 50 mm×80 mm (third generation mobile phone), a measurement zone of 6 mm×4 mm constitutes 0.6% of that active display area. For a laptop screen with an active display area with dimensions of 2459 mm×1844 mm (a 12.1 inch screen), a measurement zone of 6 mm×4 mm constitutes 0.0005% of that active display area.

No dedicated test pixels are necessary, any pixels in the active display area can be used for carrying out optical measurements thereupon. A test patch may be generated and superimposed on the active pixels such as OLED pixels viewed by the sensor. This makes it possible for the system to be retrofitted on any existing display devices. Furthermore, parts of the display device, such as the screen, can be easily replaced.

Preferably, a housing of the optical sensor unit stands out above the active display area by a distance lower than 0.5 cm.

The present invention also includes a control unit to compensate for ageing effects of pixels displaying an image on a display device, the control unit comprising:

means for allowing display of a first image on an active display area on the display device having a first plurality of pixels, means for allowing display of a second image on a sub-area of the active display area and having a second plurality of pixels, the active display area being larger than the sub-area and the second image being smaller than the first image and having fewer pixels than the active display area, means for controlling driving the pixels of the sub-area according to parts of the first image, and means for controlling the display of the image on the active display area in accordance with the optical measurement signals of the sub-area.

The present invention also includes computer program product comprising code segments adapted for execution on any type of computing device, the code segments when executed on a computing device provide:

means for allowing display of a first image on an active display area on the display device having a first plurality of pixels, means for allowing display of a second image on a sub-area of the active display area and having a second plurality of pixels, the active display area being larger than the sub-area and the second image being smaller than the first image and having fewer pixels than the active display area, means for controlling driving the pixels of the sub-area according to parts of the first image, and means for controlling the display of the image on the active display area in accordance with the optical measurement signals of the sub-area.

The present invention also includes a machine readable signal storage medium storing the computer program product. The medium may be a disk medium such as a diskette or harddisk, a tape storage medium, a solid state memory such as RAM or a USB memory stick, an optical recording disk such as a CD-ROM or DVD-ROM, etc.

Other features and advantages of the present invention will become apparent from the following detailed description, taken in conjunction with the accompanying drawings, which illustrate, by way of example, the principles of the invention.

In the different drawings, the same reference figures refer to the same or analogous elements.

Figure 7:
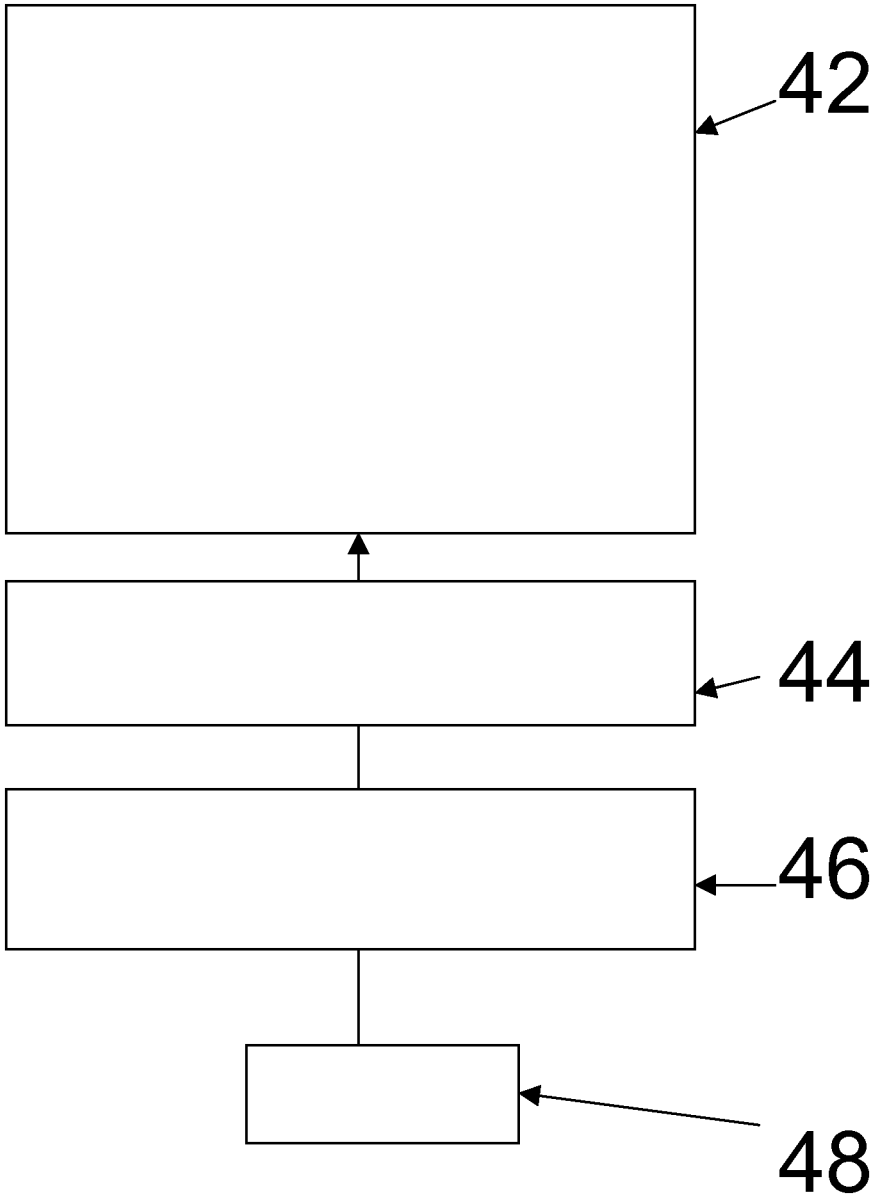

FIG. 7 is schematic representation of a display system according to an embodiment of the present invention.

Figure 8:
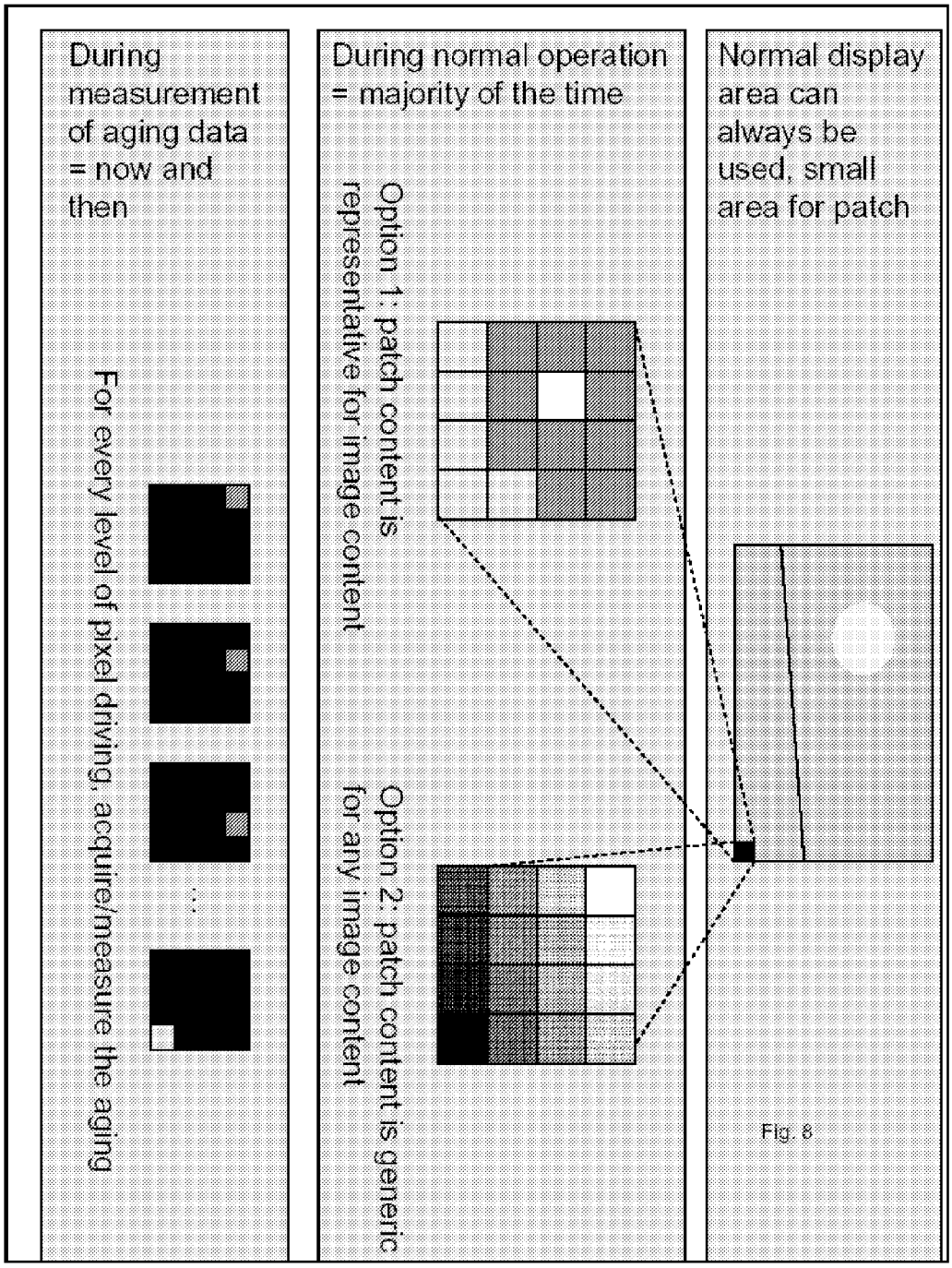

FIG. 8 is a schematic representation of embodiments of the present invention.

DESCRIPTION OF THE ILLUSTRATIVE EMBODIMENTS

The present invention will be described with respect to particular embodiments and with reference to certain drawings but the invention is not limited thereto but only by the claims. The drawings described are only schematic and are non-limiting. In the following the acceptance angle of a sensor refers to the angle subtended by the extreme light rays which can enter the sensor. The angle between the optical axis and the extreme rays is therefore usually half of the acceptance angle.

FIG. 7 is a schematic representation of a display system, e.g. an OLED display that can be used with the present invention including a signal source 48 a controller unit 46, a driver 44 and a display 42 with a matrix of pixel elements that are driven by the driver 44. The invention makes use of a sub-area (patch) of the screen in a way that is optimised for/adapted to emissive displays. The sub-area is a measurement zone that contains more than 1 pixel, and spatial intelligence is added to the content being shown in the measurement area. In particular in one embodiment spatial partitioning is used. In OLED displays the ageing of the pixels is dependent of the pixel-history With reference to FIG. 8, the display comprises an array of pixels and a small portion of these pixels is used as a sub-area (patch) or measurement zone. The pixels in the sub-area or measurement zone are driven in accordance with one or more algorithms each of which is an embodiment of the present invention. The pixels in the sub-area are can be driven in the same way as pixels of the main part of the display, i.e. the active display area. The active display area and the sub-area are in one single display device. In this way the pixels in the sub-area age at the same rate as pixels or pixel regions of the main display. The pixels in the sub-area may also be driven at selected different levels and their ageing is measured continuously. The ageing of the pixels in the sub-area can then be input into a model that relates pixel drive history to ageing effects. This model can be continuously or periodically updated based on the ageing effects of the pixels in the sub-area. In this way continuous, realtime values of the ageing properties of the complete display and its different pixel driving histories are obtained.

The selected levels can be a function of what is shown in the visible area (i.e. the pixels in the sub-area are driven in a representative manner of the pixels in the active display area of the display), or a generic pattern that gives us information about a broad range of pixel levels (i.e. the pixels in the sub-area are driven in a way that is indicative of the ageing of the pixels in the active display area).

An advantage of the present invention in emissive displays is compensation of the ageing that is dependent on the history of the pixel driving. By giving the system access to a large collection of accurate ageing statistics, ageing can be accurately corrected. To implement these ageing algorithms and models a sub-area or measurement zone is provided on the display. Non-limiting embodiments of such a measurement zone are described below.

Figure 1A:
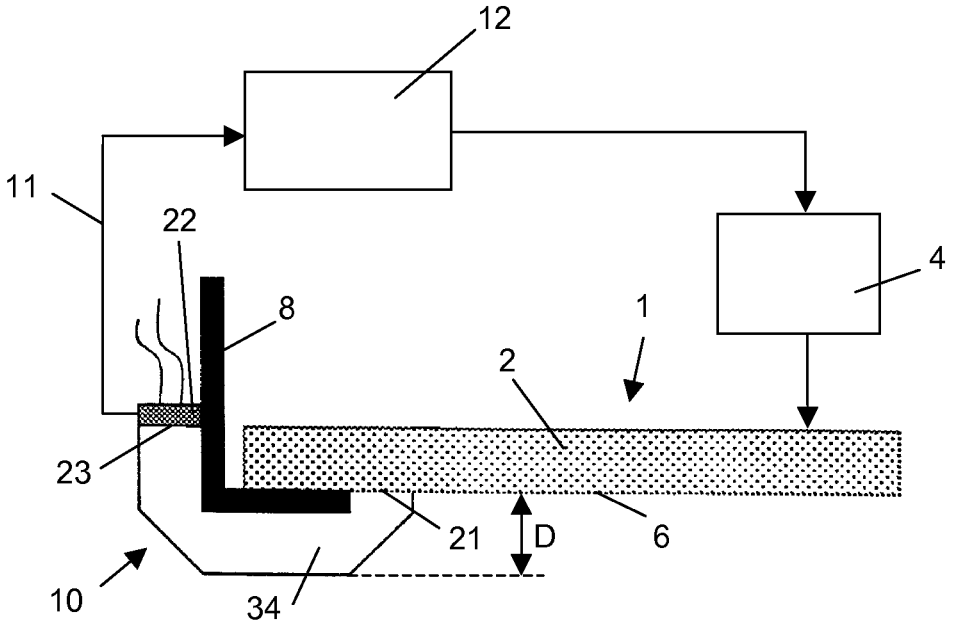
FIG. 1A is a top view and FIG. 1B is a front view of a part of an OLED screen provided with an optical sensor unit according to the present invention.
Figure 1B:
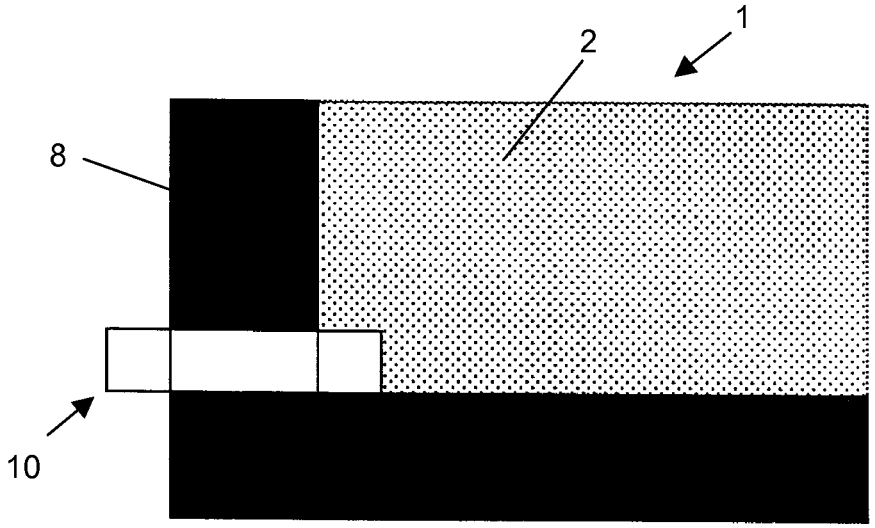

FIG. 1A and FIG. 1B are a top view and a front view respectively of a part of an OLED display device 1 provided with an optical sensor unit 10 for use with an embodiment according to the present invention. Neither the arrangement of the sensor nor the type of sensor is considered to be a limitation on the present invention.

An OLED display device 1 comprises an OLED panel 2 and an electronic driving system 4 for driving the OLED panel 2 to generate and display an image. The display device 1 has an active display area 6 on which the image is displayed as well as a sub-area 7 on which the same image is shown as on the whole display area 6. The OLED panel 2 is kept fixed in an OLED panel bezel 8.

According to the present invention, a display device 1 is provided with an optical sensor unit 10 to make optical measurements on a light output from a sub-area 7 of the OLID panel 2. Optical measurements signals 11 are generated from those optical measurements.

A feedback system 12 receives the optical measurement signals 11, and controls the electronic driving system 4 on the basis of those signals.

Several ways exist to realise the optical sensor unit 10. In all cases, the optical sensor unit 10 is permanently or removably fixed to (or adjacent to) the active display area 6. The whole of the optical sensor unit 10 can be calibrated together and can also be interchangeable.

Typically, the optical sensor unit 10 has a light entrance plane or optical aperture 21 and a light exit plane 23. It can also have internal reflection planes. The light entrance plane 21 preferably has a stationary contact with the active display area 6 which is light tight for ambient light. If the contact is not light tight it may be necessary to compensate for ambient light by using an additional ambient light sensor which is used to compensate for the level of ambient light.

Preferably, the optical sensor unit 10 stands out above the active display area a distance D of 5 mm or less.

Figure 2:
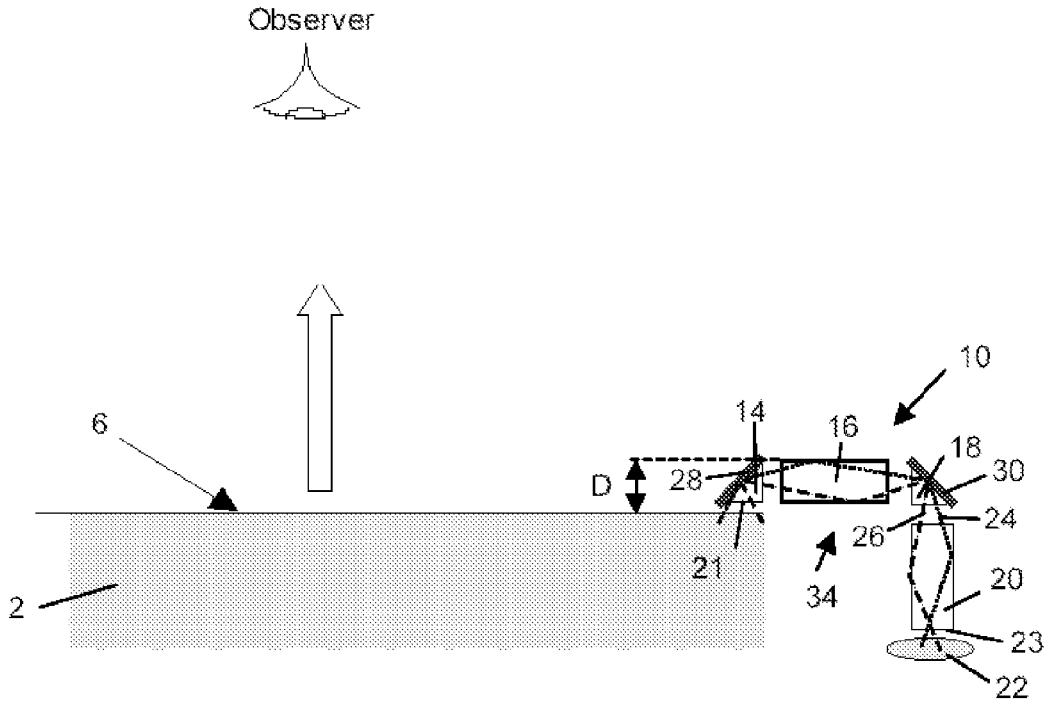
FIG. 2 shows a first embodiment of an optical sensor unit according to the present invention, the unit comprising a light guide being assembled of different pieces of PMMA.

According to a first embodiment, as shown in FIG. 2, the optical sensor unit 10 comprises an optical aperture 21, a photodiode sensor 22 and in between, as a light guide 34, made from, for example, massive PMMA (polymethyl methacrylate) structures 14, 16, 18, 20, of which one presents an aperture 21 to collect light and one presents a light exit plane 23. PMMA is a transparent (more than 90% transmission), hard and stiff material. The skilled person will appreciate that other materials may be used, e.g. glass.

The massive PMMA structures 14, 16, 18, 20 serve for guiding light rays using total internal reflection. The PMMA structures 14 and 18 deflect a light bundle over 90°. The approximate path of two light rays 24, 26 is shown in FIG. 2.

The oblique parts of PMMA structures 14 and 18 are preferably metallised 28, 30 in order to serve as a mirror. The other surfaces do not need to be metallised as light is travelling through the PMMA structure using total internal reflection.

In between the different PMMA structures 14, 16, 18 and 20 there is an air gap. At these interfaces, stray light (which is light not emitted by the display device) can enter the light guide 34.

Figure 3:
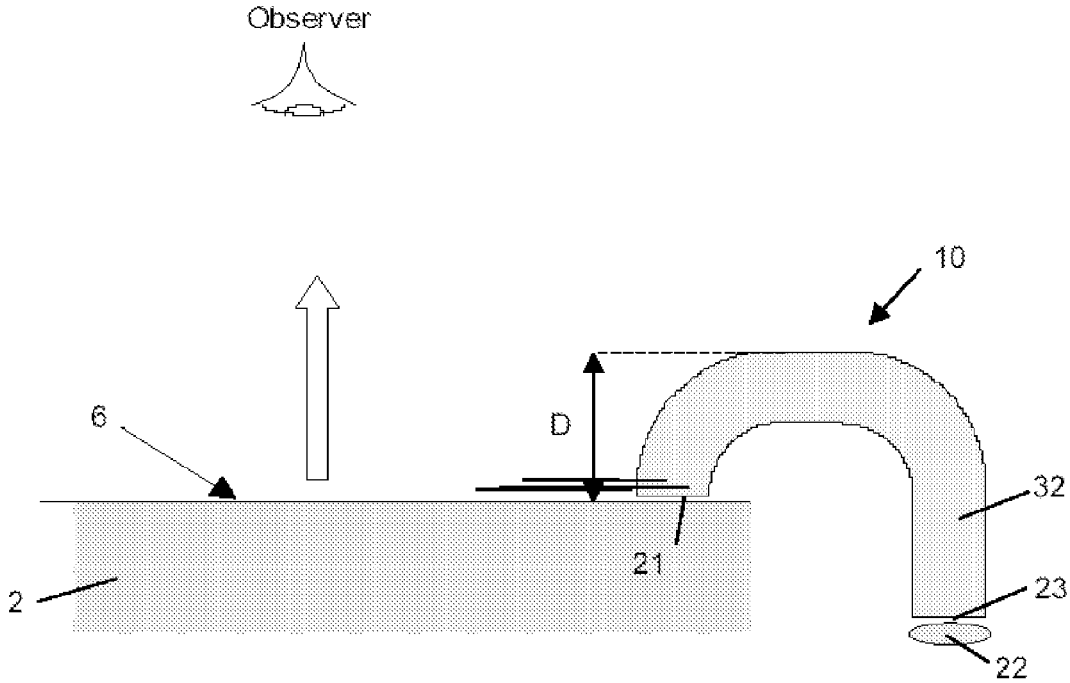
FIG. 3 shows a second embodiment of an optical sensor unit according to the present invention, the unit comprising a light guide with optical fibres.

Another type of optical sensor unit 10 that can be used with embodiments according to the present invention is shown in FIG. 3. It is a fiber-optic implementation. The optical sensor unit 10 comprises an optical aperture 21 and a light sensor 22, with a bundle 32 of optical fibres there between. The optical fibres are preferably fixed together or bundled (e.g. glued), and the end surface is polished to accept light rays under a limited angle only (as defined in the attached claims).

Figure 4:
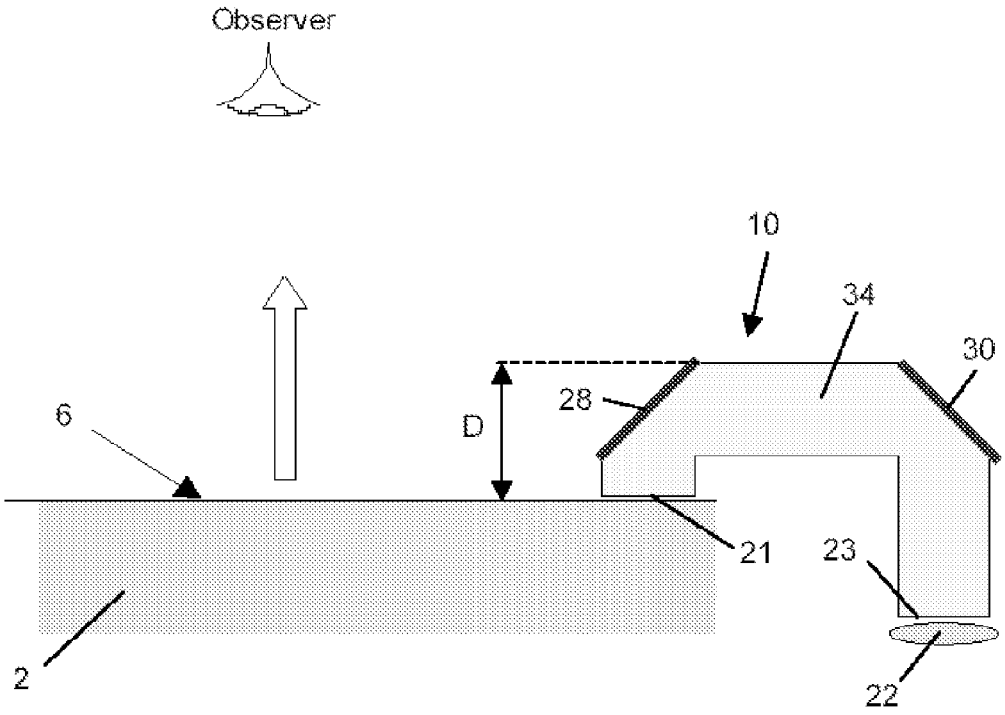
FIG. 4 shows a third embodiment of an optical sensor unit according to the present invention, the unit comprising a light guide made of one single piece of PMMA.
Figure 5:
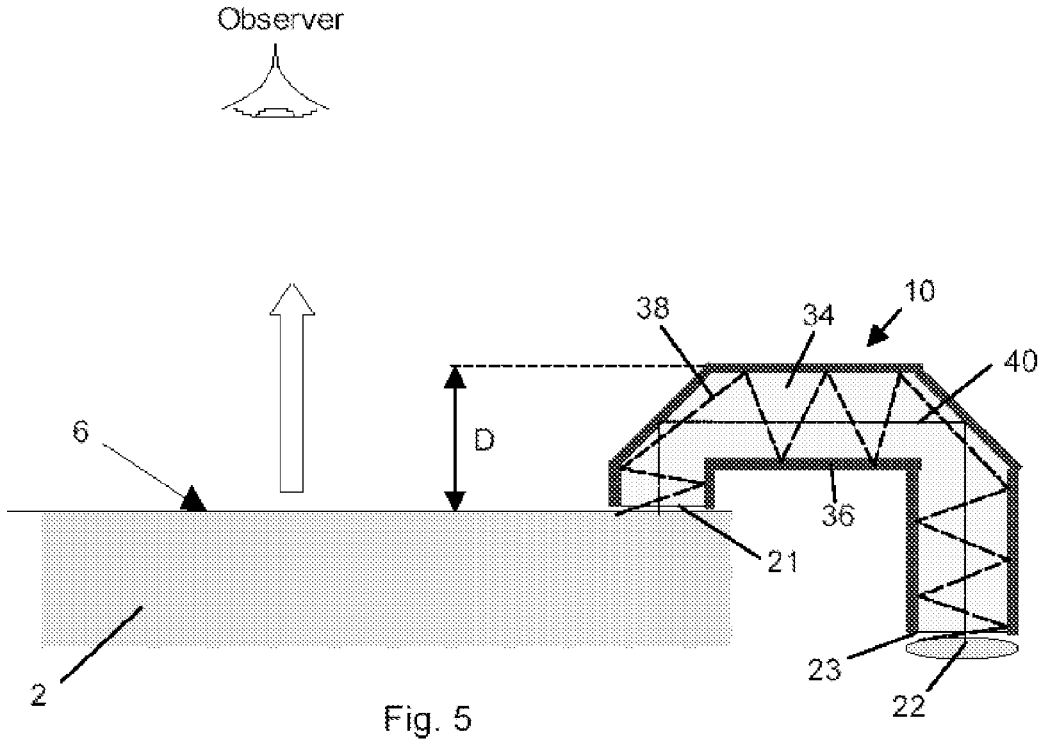
FIG. 5 shows the light guide of FIG. 4, this light guide being coated with a reflective coating.
Figure 6:
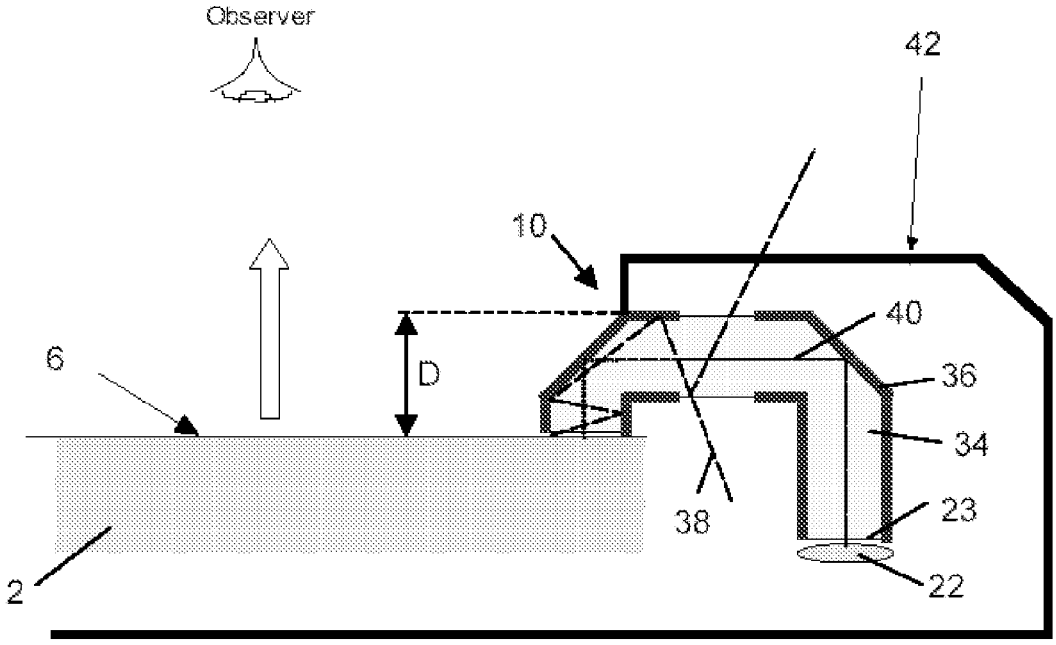
FIG. 6 shows the light guide of FIG. 4, this light guide being partially coated with a reflective coating, and the light guide being shielded from ambient light by a housing.

A third optical sensor unit that can be used with embodiments according to the present invention is shown in FIG. 4-FIG. 6. In this embodiment, the optical sensor unit 10 comprises a light guide 34 made of one piece of PMMA. The optical sensor unit 10 furthermore comprises an aperture 21 at one extremity of the light guide 34, and a photodiode sensor 22 or equivalent device at the other extremity of the light guide 34. The light guide 34 can have a non-uniform cross-section in order to concentrate light to the light exit plane 23.

Light rays travel by total internal reflection through the light guide 34. At 90° angles, the light rays are deflected by reflective areas 28, 30, which are for example metallised to serve as a mirror, as in the first embodiment. The structure of this light guide 34 is rigid and simple to make.

In an improvement of the structure (see FIG. 5), a reflective coating 36 is applied directly or indirectly (i.e. non separable or separable) to the outer surface of the light guide 34, with exception of the areas where light is coupled in (aperture 21) or out (light exit plane 23). The reflection coefficient of this reflective coating material 36 is 0.9 or lower. The coating lays at the surface of the light guide 34 and may not penetrate in it.

In this case, ambient light is very well rejected. At the same time, the structure provides a narrow acceptance angle: light rays that enter the light guide 34 under a wide angle to the normal to the active display area 6, such as the ray represented by the dashed line 38, will be reflected and attenuated much more (because the reflection coefficient being 0.9 or lower) than the ray as represented by the dotted line 40 which enters the structure under a narrow angle to the normal to the active display area 6.

The structure can further be modified to change the acceptance angle, as shown in FIG. 6. By selectively omitting the reflective layer 36 on the surface of the light guide 34, at places where the structure is not exposed to ambient light (e.g. where it is covered by a display housing 42), the light rays travelling under a large angle to the axis of the light guide 34 (or to the normal to the active display area 6) can be made to exit the optical sensor unit 10, while ambient light cannot enter the light guide 34.

In this way, light rays that enter the light guide 34 under a wide angle to the normal to the active display area 6, such as a light ray represented by dashed line 38, will be further attenuated and even be allowed to exit the light guide 34. Light rays that enter the light guide 34 under a small angle to the normal of the active display area 6, such as a light ray represented by dotted line 40, will be less attenuated and will only leave the light guide 34 at the level of the light exit plane 23 and photodiode sensor 22. Therefore, the light guide 34 is much more selective as a function of entrance angle of the light rays. This means that this light guide 34 realises a narrow acceptance angle. Making use of an optical sensor as described above the present invention provides a method for compensating ageing effects, especially based on differential ageing of the pixels, of an image displayed on a display device, e.g. an OLED device with OLED pixels. To achieve this compensation a first image which is an arbitrary image displayed on an active display area 6 of the display device 1 making use of a first plurality of pixels. To make sure that ageing of the display can be determined in a representative way, a second image is displayed on a sub-area 7 of the display device 1 having a second plurality of pixels. The first display area and the sub-area are in one single display device. The first area is larger than the sub-area and the second image is smaller than the first image and hence has fewer pixels than the active display area. The pixels of the sub-area can be driven according to parts of the first image, i.e. in accordance with representative parts of that image. Another option is to drive them with a generic representative collection of pixel inputs, i.e. the pixels of the sub-area are indicative of aging effects of the pixels of the active display area, e.g. the pixel ageing in the sub-area may be used in a model for ageing of pixels in the active display area. An algorithm for selecting which parts of the first image are to be used is described below.

Calibration

The well-known PPU/ULT correction algorithm can be applied to compensate for non-uniformity and spatial noise of the display. The display may be put through an initial calibration phase in which different grey levels and/or colours are displayed sequentially on the display system. For every displayed grey level and/or colour, the light output (luminance and/or colour information) is measured with a colour measurement device or spectrometer at different locations on the display system (in the limit: one measurement per display pixel). The relation between the sensor response and the response of the calibrated measurement device is stored in a memory of the display. This calibration phase allows to predict from the sensor response what the exact luminance and/or colour point will be on the OLED display itself at various positions on the display.

Real-Time Use

During use of the display the sub-area is continuously used to show selected grey levels and/or colours. These selected grey levels and/or colours are put there to follow in real-time the ageing of the OLED pixel devices. At certain timeframes the remaining efficiency of every grey level and/or colour is measured for the pixels by only turning on that grey level and/or colour and measuring the response (luminance and/or colour point) with the optical sensor. This degradation is stored in a table (e.g. degradation per grey level and/or colour over time), e.g. in a memory of the display. Note that it is also possible to start several sequences of measuring degradation. In other words, at time zero one could start measuring all 255 grey levels. But one could also reserve a zone of the sub-area to start later tests. That zone can be temporarily driven with a zero value. After a time e.g. 1000 hours one could use the reserved zone to start a new series of measurements of all grey levels, etc.

In addition, every pixel or every zone of the OLED display can be tracked as to how long that pixel or zone has been driven at a certain greylevel/colour (or current level). By measuring the degradation of the different grey levels and/or colour using the sub-area and the optical sensor the degradation of every pixel or zone of the OLED can be predicted. E.g. a pixel has been driven for 2000 hours at 100% video and 100 hours at 20% video. The zones in the sub-area measured by the optical sensor are examined to see how the 100% video has degraded after 2000 hours. This is representative for the degradation of that pixel during the 2000 hours that it was driven to 100%. In the same way one can look how the 20% video degraded after 100 hours. By combining these data we can know the total degradation of the pixel.

How a pixel has been driven can be tracked in time rather than only taking the total time. This gives a more accurate input for a model because it also takes into account the exact degradation at a particular moment in time. E.g. if the degradation of all grey levels every 30 minutes is measured, then every pixel of the OLED display can be examined for the degradation that has occurred when driving a pixel at a certain video level and moreover at a certain moment in time. This embodiment allows accurate compensation when e.g. ambient temperature or moisture level changes. Optionally recalibration of the device can be carried out.

According to the embodiments described above optical measurements are made on light emitted from the sub-area 7 resulting in optical measurement signals 11. The display is then controlled so that ageing effects on the pixels of the active display area are compensated. The active display area and the sub-area are in one single display device. Hence the display of the first image on the active display area 6 is in accordance with the optical measurement signals 11 taken from the sub-area 7.

The display can be an OLED display. The compensation method makes use of actual data derived from an optical measurement of pixels that have been driven in a representative manner compared to the display as a whole. Accordingly, the second image can be selected from parts of the first image so that the second image is representative of the first image but smaller in size. Advantageously this can be combined with the "model" approach to compensate for ageing effects more accurately. Such a model is based on the material parameters of the device that link the electrical input and the optical output. Furthermore it is based a priori measured data about the aging. By combining the parameters that quantify the aging, a model for this behaviour can be fitted.

By placing a light sensor opposite a sub-area of the screen, for instance in a corner of the screen, the light coming from this small sub-area can be measured. As the sensor is applied external to display, no amendments of the pixels are required. Only the way the pixels are driven needs to be changed and this lies within the capabilities of a display as the pixel drivers are arranged to display arbitrary images and hence can be programmed to display a picture within a picture. So by altering the way the pixels are driven, pixels such as OLED pixels of the sub-area display a small image that is representative of the image on the complete screen or are indicative of ageing effects of pixels of the complete screen. Based on the actual display contents the typical driving values can be identified for each pixel or a representative group of pixels of the sub-area and the actual behaviour of these pixels can be, determined at any moment of the drive time. Accordingly, a more accurate correction especially for the differential ageing effects is achieved without the need to integrate a sensor in each individual pixel of the complete screen and without storing the drive history of each pixel of the complete screen.

In a preferred embodiment of the present inventive method the sub-area can again be divided into different parts which are driven with a pattern based on the actual display contents. Typical driving values such as a dynamic pattern like moving images, or temporal dither patterns of the actual displayed image can be identified for this purpose and at least one part of the sub-area of the display device can be driven with that pattern. At the same time, for each individual pixel of the sub-area the data how the pixel has been driven over the lifetime of the display can be stored. In contrast to making an estimated prediction of the actual behaviour based on a model only, with the method of the present invention now a measurement of the current behaviour of a given class of pixels like blue pixels at the top of the display device can be provided instead of storing the complete driving behaviour of each pixel of the complete display and instead of an inaccurate estimation based on a current measurement and/or a model. Moreover, the memory used to store the driving history of each of the sub-area pixels or alternatively of classes of these pixels from parts of the sub-area can be reduced.

The method for correction of an image is preferably used in real time, i.e. in parallel with a running application. The method is intervention-free, it does not require input from a user.

Preferably, the optical measurements carried out are luminance measurements. In that case, light output correction may comprise luminance and/or contrast correction. Alternatively, the optical measurements carried out are colour measurements, in which case light output correction comprises colour correction of the displayed image.

Controlling the display of the image in accordance with the optical measurement signals is preferably done by comparing the measurement signals with a reference value, and regulating a backlight controller and/or the driving current of the pixels so as to reduce the difference between the reference value and the measurement signals and bring this difference as close as possible to zero.

According to another preferred embodiment of the invention the luminance measurements are carried out in sequences. For example, at a time zero not all parts of the sub-area of the active display are used for measuring but it is also possible to reserve one part or zone of the sub-area which can be temporarily driven with zero. After 1000 hours, for example, the reserved part or zone can be used to start a new series of luminescence measurements. With this reservation it is possible to measure the degradation of differently driven pixels and then make a more accurate prediction of the degradation behaviour of the pixels such as OLED pixels.

Alternatively, the sub-area can be used and measured continuously to show the same image as the complete active display at all times. The optical measurement then is used to identify the remaining efficiency of every gray level and/or every colour. This degradation is stored in a table which shows degradation per gray level and/or colour over time.

Preferably, the step of making optical measurements furthermore comprises a step of transmitting the light emitted from the active display sub-area from within the active display sub-area to outside the active display sub-area.

It is another preferred embodiment of the present inventive method to also track in time how a pixel of the sub-area was driven. This is contrast to only track a total drive time. This allows to have an even more accurate model because it also takes into account the exact degradation at a particular moment of the lifespan. For example, if a measurement includes the measurement of all grey levels every 30 minutes it is possible to look for every pixel of the sub-area and subsequently of the whole display area what the degradation was when driving a pixel at a certain video level and moreover at a certain moment in time. This ultimately allows an accurate compensation with environmental changes, e.g. in temperature or moisture levels, also included into the model.

The present invention also provides a system for compensating ageing effects, especially based on differential ageing of pixels such as OLED pixels, of an image displayed on an OLED display device. The system according to this embodiment of the present invention has a display device comprising an active display area for displaying the image, an image forming device, such as an array of pixels such as OLED pixels, and an electronic driving system for driving the image forming device. An optical sensor unit of any suitable type is located in such a way as to make optical measurements on a light output from a sub-area of the active display area of the image forming device and to generate optical measurement signals therefrom. A feedback system is provided to receive the optical measurement signals and on the basis thereof to control the electronic driving system. The sub-area of the active display area shows an image that is representative of the image of the complete display area but is smaller than it. The optical aperture of the optical sensor unit preferably has an acceptance angle such that at least 50% of the light received by the sensor comes from light travelling within 15° of the optical axis of the light sensor (that is the acceptance angle of the sensor is)30°. In other words the acceptance angle of the sensor is such that the ratio between the amount of light used for control which is emitted or reflected from the display area at a subtended acceptance angle of 30° or less to the amount of light used for control which is emitted or reflected from the display area at a subtended acceptance angle of greater than 30° is X:1 where X is 1 or greater. Under some circumstances it may be advantageous to have an acceptance angle such that at least 60%, alternatively at least 70% or at least 75% of the light received by the light sensor comes from light travelling within 15° of the optical axis of the light sensor.

In another preferred embodiment of the invention a system for compensating ageing effects, especially based on differential ageing of the pixels, of an image displayed on an OLED display device is provided where the optical aperture of the optical sensor unit has an acceptance angle such that light received at the sensor at an angle with the optical axis of the light sensor equal to or greater than 10° is attenuated by at least 25%, light received at an angle equal to or greater than 20° is attenuated by at least 50 or 55% and light arriving at an angle equal to or greater than 35° is attenuated by at least 80 or 85%.

The system according to the present invention is meant to be used in real time, thus during display of a main application. No test pattern is necessary, although a test pattern may be used for calibration. The main application is not disturbed when the measurement in made.

The optical measurements are non-differential, i.e. ambient light and real light emitted by the active display area are not measured separately. Direct ambient light is not measured, nor does it influence the, measurement appreciably. Indirect ambient light (i.e. ambient light reflected by the display) has a contribution in the total luminance output of the electronic display, and will be measured.

In case it is the intention to adjust the luminance of a display relative to the ambient light, the combination of the invention with a separate ambient light sensor is possible. In that case, a system according to the present invention measures the luminance emitted by the sub-area of the screen, and the ambient light sensor measures the ambient light. The display's luminance can then be adjusted in proportion to the difference between both.

Preferably, the optical measurements are luminance measurements. The performance correction may then comprise luminance and/or contrast correction. The optical measurements may also be colour measurements, in which case a colour correction may be carried out.

The feedback system preferably comprises a comparator/amplifier for comparing the optical measurement signals, measured luminance or colour values, with a reference value, and a regulator for regulating a backlight control and/or a video contrast control and/or a video brightness control and/or a colour temperature, so as to reduce the difference between the reference value and the measured value and bring this difference as close as possible to zero.

The optical sensor unit of the present invention preferably comprises a light guide between the optical aperture and the light sensor. This light guide may be e.g. a light pipe or an optical fibre.

Preferably, the sub-area of the active display area of the OLED image forming device is less than 1% of the total area of the active display area of the image forming device, preferably less than 0.1%, and still more preferred less than 0.01%.

According to a preferred embodiment, the optical aperture of the optical sensor unit masks a portion of the active display area, while the light sensor itself does not mask any part of the active display area. The light output from the front face of the active display area of a display device is continuously measured with a minimal coverage of the viewed image. The light sensor may be brought to the back of the display area or to a side thereof, thereby needing a height above the screen area preferably less than 5 mm. Therefore, a distance between the optical aperture and the light sensor, needed to reject ambient light during measurement, is not created by a distance out of the screen. The sub-area measured on the screen is composed of a number of active pixels such as OLED pixels of the active display area. The sub-area of active pixels measured on'the screen is preferably not larger than 6 mm×4 mm. For example for a mobile phone screen, with typical dimensions of the active display area of 50 mm×80 mm (third generation mobile phone), a measurement zone of 6 mm×4 mm constitutes 0.6% of that active display area. For a laptop screen with an active display area with dimensions of 2459 mm×1844 mm (a 12.1 inch screen), a measurement zone of 6 mm×4 mm constitutes 0.0005% of that active display area.

No dedicated test pixels are necessary, any pixels in the active display area can be used for carrying out optical measurements thereupon. A test patch may be generated and superimposed on the active pixels such as OLED pixels viewed by the sensor. This makes it possible for the system to be retrofitted on any existing display devices. Furthermore, parts of the display device, such as the screen, can be easily replaced.

Preferably, a housing of the optical sensor unit stands out above the active display area by a distance lower than 0.5 cm.

By the small acceptance angle of the optical sensor unit 10 according to the present invention, it is avoided that ambient light enters the photodiode sensor 22, and this without having to shield from the ambient light neighbouring pixels to the pixels on which the measurement is done. Also light emitted by the OLED screen at shallow angles to its surface do not enter the sensor. Light emitted from OLED displays at angle away from the normal to the surface are often distorted in luminance and colour.

The present invention also includes a control unit for controlling a display such as an OLED display. Any of the functionality of the control unit may be implemented as hardware, computer software, or combinations of both. The control unit may include a general purpose processor, a digital signal processor (DSP), an application specific integrated circuit (ASIC), a field programmable gate array (FPGA) or other programmable logic device, discrete gate or transistor logic, discrete hardware components, or any combination designed to perform the functions described herein. A general purpose processor may be a microprocessor, controller, microcontroller or state machine. A processor may also be implemented as a combination of computing devices, e.g., a combination of a DSP and a microprocessor, a plurality of microprocessors, one or more microprocessors in conjunction with a DSP core, or any other such configuration. The control unit is adapted to carry out any method of the invention in particular to compensate for ageing effects, especially based on differential ageing of the pixels, of an image displayed on a display device. The control unit comprises: means for allowing display of a first image on an active display area 6 on the display device 1 having a first plurality of pixels, means for allowing display of a second image on a sub-area 7 on the display device 1 and having a second plurality of pixels, the active display area being larger than the sub-area and the second image being smaller than the first image and having fewer pixels than the active display area, means for controlling driving the pixels of the sub-area according to parts of the first image, and means for controlling the display of the image on the active display area 6 in accordance with the optical measurement signals 11 of the sub-area 7. The active display area and the sub-area are in one single display device. The controller may also be adapted to drive different parts of the sub-area with a pattern based on the actual display contents. The controller may also be adapted to drive different parts of the sub-area with a pattern based on a priori defined pixel values containing more than 1 driving level. Preferably, the optical measurements are luminance measurements and the controller is adapted to carry out the luminance measurements in sequences. The controller may also have means to carry out optical measurements such that light is transmitted from within the sub-area of the active display area to outside the active display area. The controller may also be adapted to track in time how a pixel of the sub-area was driven. The controller may also be adapted to carry out light output correction by luminance and/or contrast correction.

The present invention also includes a computer program product comprising code segments adapted for execution on any type of computing device, e.g. for use in a control unit of a display such as an OLED display, Software code in the computer program product, when executed on a computing device provides : means for allowing display of a first image on an active display area 6 on the display device 1 having a first plurality of pixels, means for allowing display of a second image on a sub-area 7 on the display device 1 and having a second plurality of pixels, the active display area being larger than the sub-area and the second image being smaller than the first image and having fewer pixels than the active display area, means for controlling driving the pixels of the sub-area according to parts of the first image, and means for controlling the display of the image on the active display area 6 in accordance with the optical measurement signals 11 of the sub-area 7. The active display area and the sub-area are in one single display device. The software code may also be adapted to drive with a pattern based on the actual display contents different parts of the sub-area. The software code may also be adapted to drive with a pattern based on a priori defined pixel values containing more than 1 driving level different parts of the sub-area. Preferably, the optical measurements are luminance measurements and the software may be adapted to carry out the luminance measurements in sequences. The software code may also be adapted to carry out the step of making optical measurements such that light is transmitted from within the sub-area of the active display area to outside the active display area. The software code may also be adapted to track in time how a pixel of the sub-area was driven. The software may also be adapted to carry out light output correction by luminance and/or contrast correction.

While the invention has been shown and described with reference to preferred embodiments, it will be understood by those skilled in the art that various changes or modifications in form and detail may be made without departing from the scope and spirit of this invention. For example dimensions of the optical sensor unit can be varied (a bigger or smaller optical sensor unit), thus also the dimensions of the measurement zone can be bigger or smaller. Also the geometry of the optical sensor unit can be varied. Even if geometry and/or dimensions of the optical sensor unit are changed, preferably the optical sensor unit stands out above the active display area by a distance lower than 0.5 cm. Furthermore, applications may be slightly different. For example, the luminance can be measured for each colour, either sequentially or by a combination of sensors with appropriate filters, to measure or stabilise the colour temperature, which is defined by the mixture of the primary colours, in most cases R, G and B. As another example, the method and device can be used to stabilise the contrast value of the luminance measured with the described system, and the ambient light measured with a second sensor which does not point at the active area of the display, but which points at the room environment or to a non-active border of the display. In this case, the display of the image on the active display area is controlled in accordance with the optical measurement signals of the sub-area in combination with the ambient light measurement signals.

The invention claimed is:

1. A method for compensating effects of ageing of pixel outputs displaying an image on a display device having an optical sensor comprising an optical aperture and a light sensor having an optical axis, the method comprising:

displaying a first image on an active display area on the display device having a first plurality of pixels;

displaying a second image on a sub-area of the display device and having a second plurality of pixels, the active display area being larger than the sub-area and the second image being smaller than the first image and having fewer pixels than the active display area;

driving the pixels of the sub-area with electronic signals having values that are representative or indicative for the pixels in the active display area;

making optical measurements along said optical axis of the light sensor on light emitted from the sub-area and generating optical measurement signals therefrom; and controlling the display of the image on the active display area in accordance with the optical measurement signals of the sub-area.

2. The method according to claim 1, wherein the sub-area are divisible into different parts which are driven with a pattern based on the actual display contents, or the sub-area is divisible into different parts which are driven with a pattern based on a priori defined pixel values containing more than one driving level.

3. The method according to claim 1, wherein the optical measurements are luminance measurements.

4. The method according to claim 3, wherein the luminance measurements are carried out in sequences.

5. The method according to claim 1, wherein a step of tracking in time how a pixel of the sub-area was driven is included.

6. A control unit to that compensates for effects on ageing of pixels displaying an image on a display device, the control unit comprising means to execute the steps of claim 1.

7. The control unit according to claim 6, further adapted to drive different parts of the sub-area with a pattern based on the actual display contents.

8. The control unit of claim 6 further adapted to drive different parts of the sub-area with a pattern based on a priori defined pixel values containing more than one driving level.

9. The control unit of claim 6, wherein the optical measurements are luminance measurements and the controller is adapted to carry out the luminance measurements in sequences.

10. The control unit of claim 6, further comprising means to carry out optical measurements such that light is transmitted from within the sub-area of the active display area to outside the active display area.

11. The control unit of claim 6, further adapted to track in time how a pixel of the sub-area was driven.

12. The control unit of claim 6, further adapted to carry out light output correction by luminance and/or contrast correction.

13. The system for real time correction of light output and/or colour of an image displayed on a display device, the system comprising:

a display device comprising an active display area for displaying the image, an image forming device, and an electronic driving system for driving the image forming device;

an optical sensor unit comprising an optical aperture and a light sensor having an optical axis arranged to make optical measurements on a light output from a sub-area of the active display area of the image forming device and generating optical measurement signals therefrom;

a feedback system receiving the optical measurement signals and on the basis thereof controlling the electronic driving system; and wherein the sub-area of the active display area is adapted to show an image that is representative or indicative of the image of the complete active display area.

14. The system according to claim 13, wherein the optical measurements are luminance measurements.

15. The system according to claim 14, wherein light output correction comprises luminance and/or contrast correction.

16. The system according to claim 13, wherein the sub-area of the active display area of the image forming device is less than 1% of the area of the active display area of the image forming device.

17. The system according to claim 13, wherein the optical aperture of the optical sensor unit masks a portion of the active display area, while the light sensor does not mask any part of the active display area.

18. The system according to claim 13, wherein the optical sensor unit stands out above the active display area a distance of 5 mm or less.

19. A non-transitory computer readable medium having a computer program product comprising code segments adapted for execution on any type of computing device, the code segments when executed on a computing device providing:

means for allowing display of a first image on an active display area on the display device having a first plurality of pixels;

means for allowing display of a second image on a sub-area of the active display area and having a second plurality of pixels, the active display area being larger than the sub-area and the second image being smaller than the first image and having fewer pixels than the active display area;

means for controlling driving the pixels of the sub-area according to parts of the first image;

means for generating optical measurement signals from optical measurements on a light output from a sub-area of the active display area of the image forming device from an optical sensor unit comprising an optical aperture and a light sensor having an optical axis arranged to make said optical measurements; and means for controlling the display of the image on the active display area in accordance with the optical measurement signals of the sub-area.

* * * * *